US007618274B2

(12) United States Patent
Nakamura

(10) Patent No.: US 7,618,274 B2
(45) Date of Patent: Nov. 17, 2009

(54) SHORTING TERMINAL, A CONNECTOR AND AN ASSEMBLING METHOD THEREFOR

(75) Inventor: Hideto Nakamura, Yokkaichi (JP)

(73) Assignee: Sumitomo Wiring Systems, Ltd (JP)

( * ) Notice: Subject to any disclaimer, the term of this patent is extended or adjusted under 35 U.S.C. 154(b) by 0 days.

(21) Appl. No.: 12/107,113

(22) Filed: Apr. 22, 2008

(65) Prior Publication Data

US 2008/0261425 A1 Oct. 23, 2008

(30) Foreign Application Priority Data

Apr. 23, 2007 (JP) ..... 2007-112489
Apr. 26, 2007 (JP) ..... 2007-116327
Aug. 10, 2007 (JP) ..... 2007-209454

(51) Int. Cl.
*H01R 29/00* (2006.01)

(52) U.S. Cl. ..... 439/188; 439/489

(58) Field of Classification Search ..... 439/188, 439/489, 354
See application file for complete search history.

(56) References Cited

U.S. PATENT DOCUMENTS 5,647,754 A 7/1997 Kohno
5,743,760 A 4/1998 Inaba et al.
5,857,857 A 1/1999 Fukuda
5,863,216 A 1/1999 Tsuji et al.
6,551,115 B1 4/2003 Li et al.
7,275,946 B2 * 10/2007 Ohtaka et al. ..... 439/188
2007/0054547 A1 3/2007 Ohtaka et al.

* cited by examiner

*Primary Examiner*—Khiem Nguyen
(74) *Attorney, Agent, or Firm*—Gerald E. Hespos; Anthony J. Casella

(57) ABSTRACT

A connector is provided with a plurality of terminal fittings (40), a shorting terminal (10) for shorting corresponding terminal fittings (40), and a housing (50) for accommodating the terminal fittings (40) and the shorting terminal (10). The shorting terminal (10) includes a contact piece (17) formed by bending and pushed at the time of insertion into the housing (50) and a support (21) formed by bending and held in contact with the contact piece (17) from a side opposite to a push-in direction into the housing (50). When a jig for pushing the shorting terminal (10) is pressed against a pushable surface (19) of the contact piece (17), the contact piece (17) can be prevented from being inclined in the push-in direction to be deformed by being supported by the support (21).

7 Claims, 14 Drawing Sheets

SHORTING TERMINAL, A CONNECTOR AND AN ASSEMBLING METHOD THEREFOR

BACKGROUND OF THE INVENTION

1. Field of the Invention

The invention relates to a shorting terminal and a connector.

2. Description of the Related Art

U.S. Pat. No. 5,743,760 discloses a connector with a housing and terminal fittings accommodated in the housing. A shorting terminal also is mounted in the housing and includes touching pieces for touching and shorting the terminal fittings. The shorting terminal also has two contact pieces to be pushed by a jig upon accommodating the shorting terminal into the housing. An automatic machine can be used to mount the shorting terminal into the housing and, in such a case, the mounting operation is stopped automatically when the shorting terminal is pushed by a specified stroke.

The contact pieces are formed by bending plates of the shorting terminal, and the jig is pressed against these bent plates. There is a possibility that the contact pieces will be inclined and deformed by the pushing force of the jig. Therefore, the specified stroke of the automatic machine might leave the shorting terminal at a position before a proper position.

The invention was developed in view of the above situation and an object thereof is to enable a shorting terminal to be mounted at a proper position in a housing.

SUMMARY OF THE INVENTION

The invention relates to a shorting terminal to be accommodated in a housing to short terminal fittings in the housing. The shorting terminal comprises at least one contact piece that can be pushed during insertion into the housing, and at least one support that engages the contact piece from a side opposite to the push-in direction into the housing. The support ensures that the contact piece is not inclined and deformed by a jig pressed against the contact piece. Accordingly, the shorting terminal will be accommodated at a proper position if pushed by a specified stroke, and the shorting terminal can be mounted easily using an automatic machine.

The contact piece and the support preferably are formed by bending.

The shorting terminal preferably has plural resiliently deformable touching pieces that can touch and short corresponding terminal fittings.

The contact piece and/or the support preferably are arranged to contact the touching pieces to prevent excessive resilient deformations of the touching pieces. Thus, satisfactory resilient forces can be maintained for the touching pieces even if the shorting terminal is used repeatedly.

Plate surfaces of the contact piece and the support preferably cross at an angle to each other, and crossing ends of the contact piece and the support are interlocked by the engagement of projections and recesses. Thus, a supporting force by the support is increased and deformation of the contact piece is prevented more reliably. Accordingly, the jig can be operated on either the support or the contact piece, and the mounting direction of the shorting terminal into the housing can be at an angle to the push-in direction acting on the contact piece.

The shorting terminal preferably comprises at least one locking piece to lock the terminal fitting in the housing. The locking piece extends obliquely to the inserting direction of the terminal fitting into a shorting terminal accommodating chamber of the housing.

The shorting terminal preferably comprises a main body formed with one or more bevels by having one or more corners of a front end cut obliquely, so that the bevels guide the insertion of the shorting terminal.

The invention also relates to a connector comprising a housing. Terminal fittings and the above described shorting terminal are mounted in the housing. The shorting terminal is disposed and configured for shorting corresponding terminal fittings.

The shorting terminal preferably has two resiliently deformable touching pieces that touch and short the corresponding terminal fittings. A mating housing includes a disengaging portion that contacts at least one of the two touching pieces as the two housings are connected for deforming the touching pieces and canceling the shorted state. The disengaging portion includes a rib extending in a connecting direction of the two housings.

The disengaging portion becomes narrower if the connector is miniaturized, and the strength thereof might be insufficient. However, the rib extends in the connecting direction and compensates for the shortage of strength of the disengaging portion.

At least part of the disengaging portions includes at least one first rib between two disengagement guiding surfaces and one or more second ribs paired in the width direction at positions at least partly vertically overlapping with the two disengagement guiding surfaces in the height direction. Lateral shaking movements of the touching pieces are prevented substantially by the first ribs.

At least one wire pressing member is formed on the housing and communicate with the cavities. The wire pressing member has projections and can prevent loose movements of wires in cavities of the housing by being inserted into the accommodating chamber to cause the respective projections to engage or bite into the wires.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A first embodiment of the invention is described with reference to FIGS. 1 to 6. A connector of this embodiment has a shorting terminal 10, male terminal fittings 40, a male housing 50 and a retainer 80.

Figure 2:
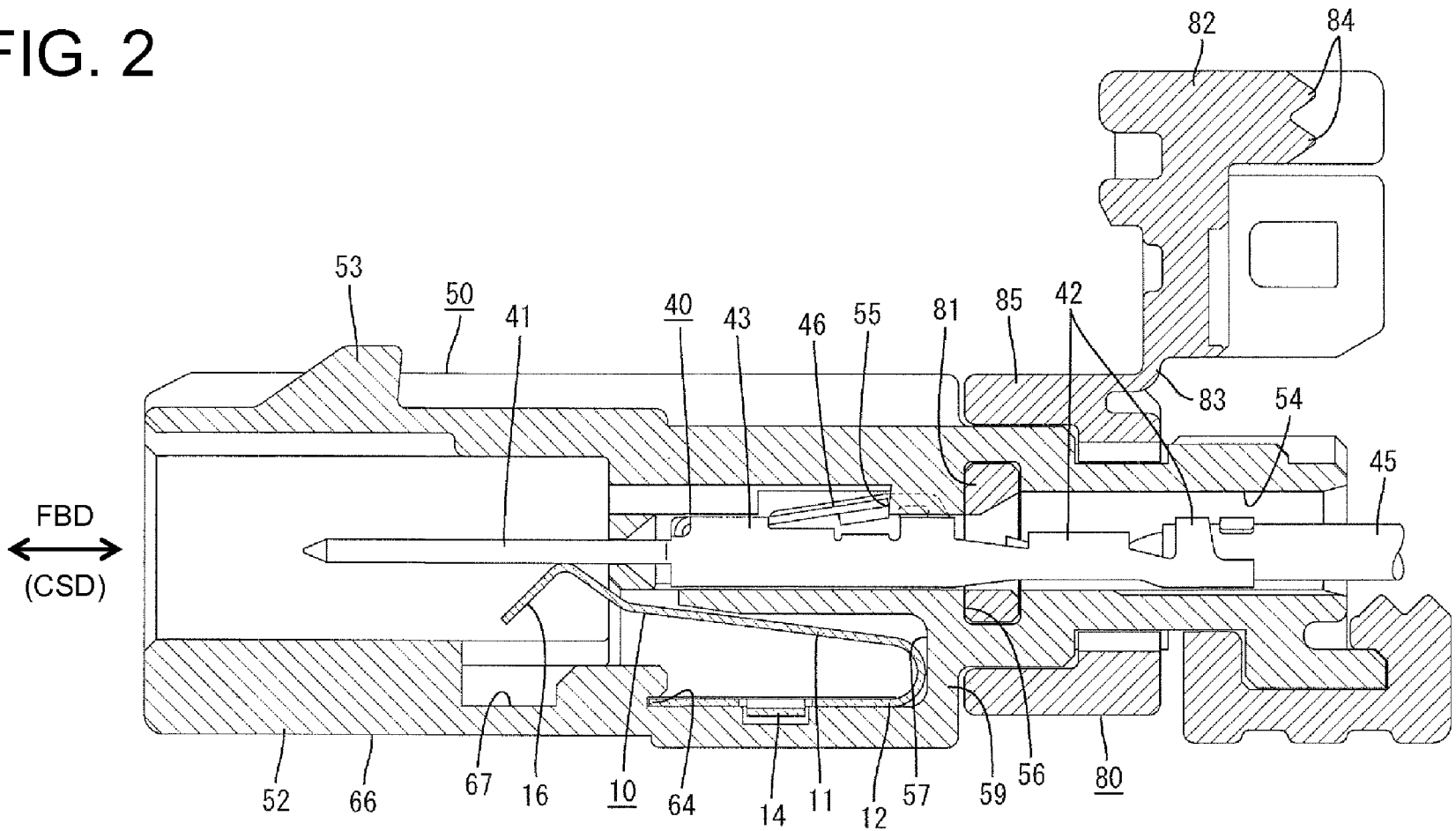
FIG. 2 is a side view in section of the connector.

Each terminal fitting 40 is formed of an electrically conductive metal plate material and has opposite front and rear ends. A tab 41 is formed at the front end, a wire connection barrel 42 is formed at the rear end and a terminal main portion 43 is formed at an intermediate part, as shown in FIG. 2. The tab 41 can be inserted into a tube 91 of the mating female terminal fitting 90 for connection with the mating female terminal fitting 90. The wire connection barrel 42 can be crimped, bent or folded into connection with an end of a wire 45. The terminal main portion 43 is substantially tubular with open front and rear ends. A metal lock 46 is formed by making at least one cut in a surrounding wall of the terminal main portion 43 and bending the cut part outward.

Figure 1:
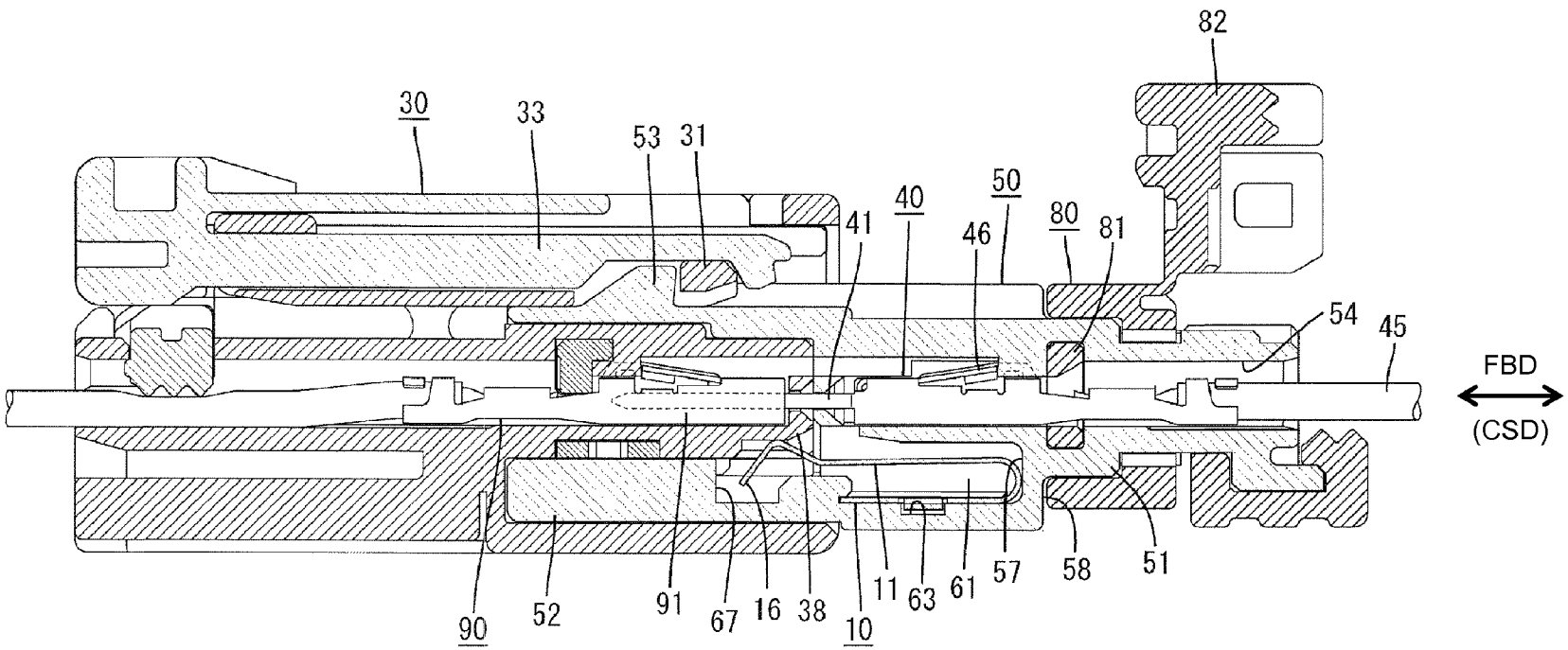
FIG. 1 is a side view in section showing a connector properly connected with a mating female connector in a first embodiment of the invention.
Figure 6:
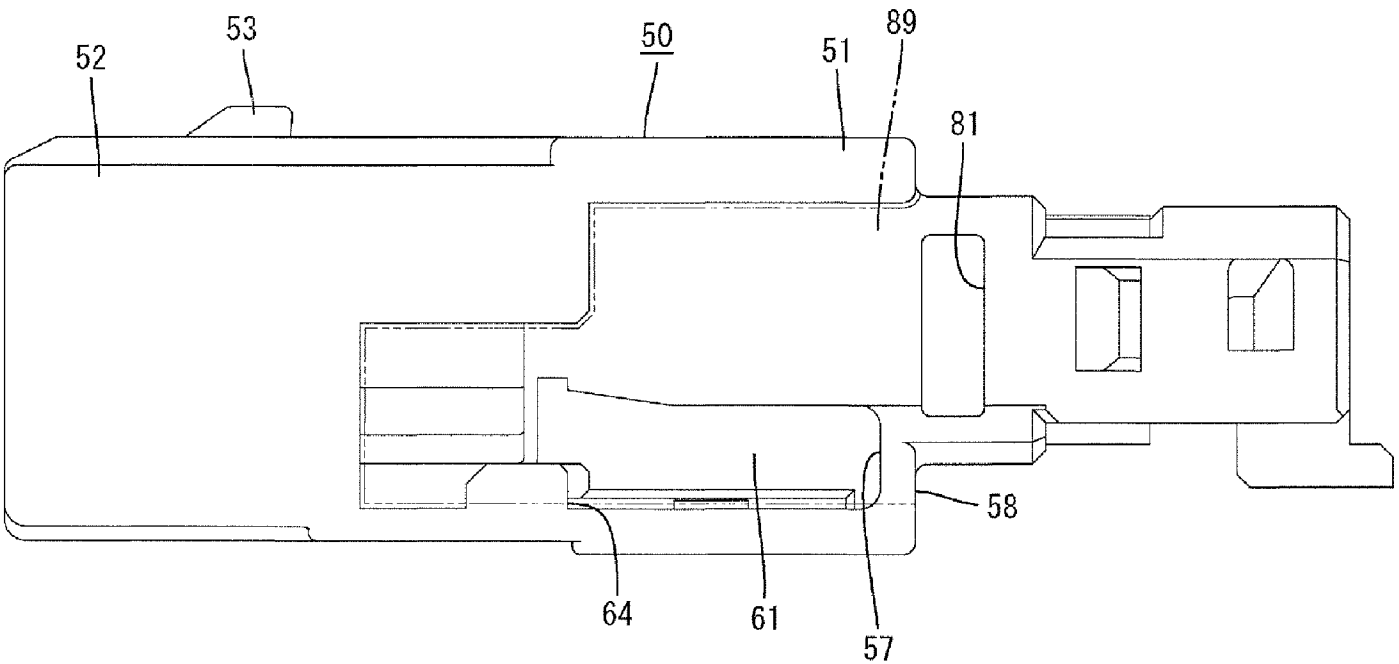
FIG. 6 is a side view of the connector housing.
Figure 7:
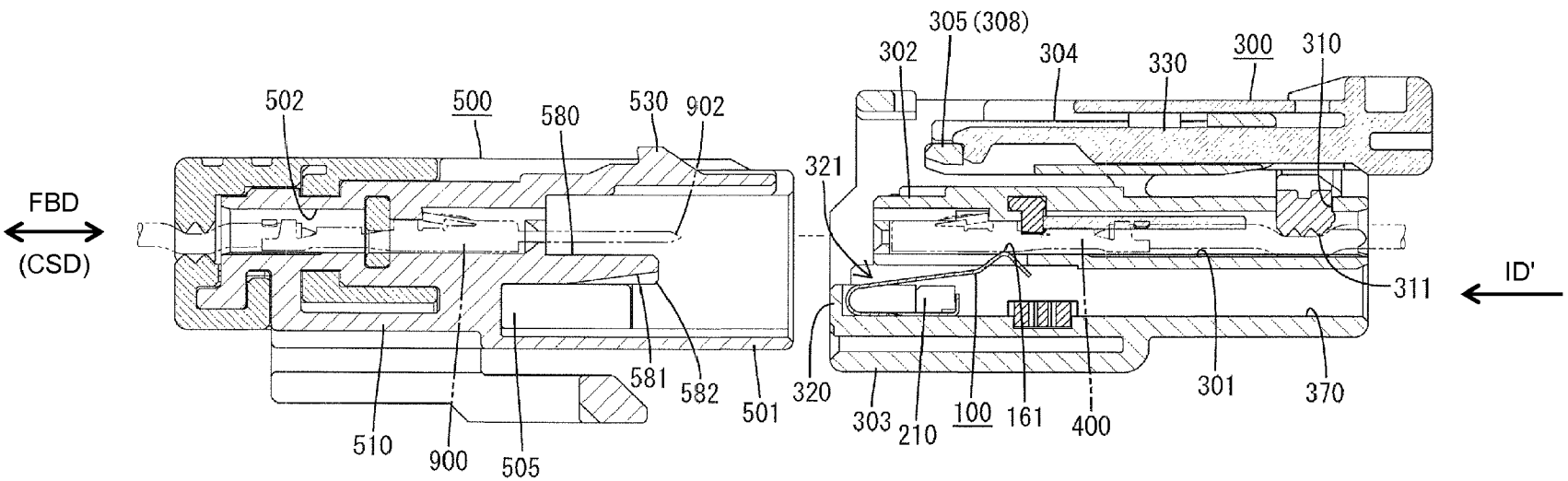
FIG. 7 is a side view in section showing a state before connectors are connected in a second embodiment of the invention.
Figure 8:
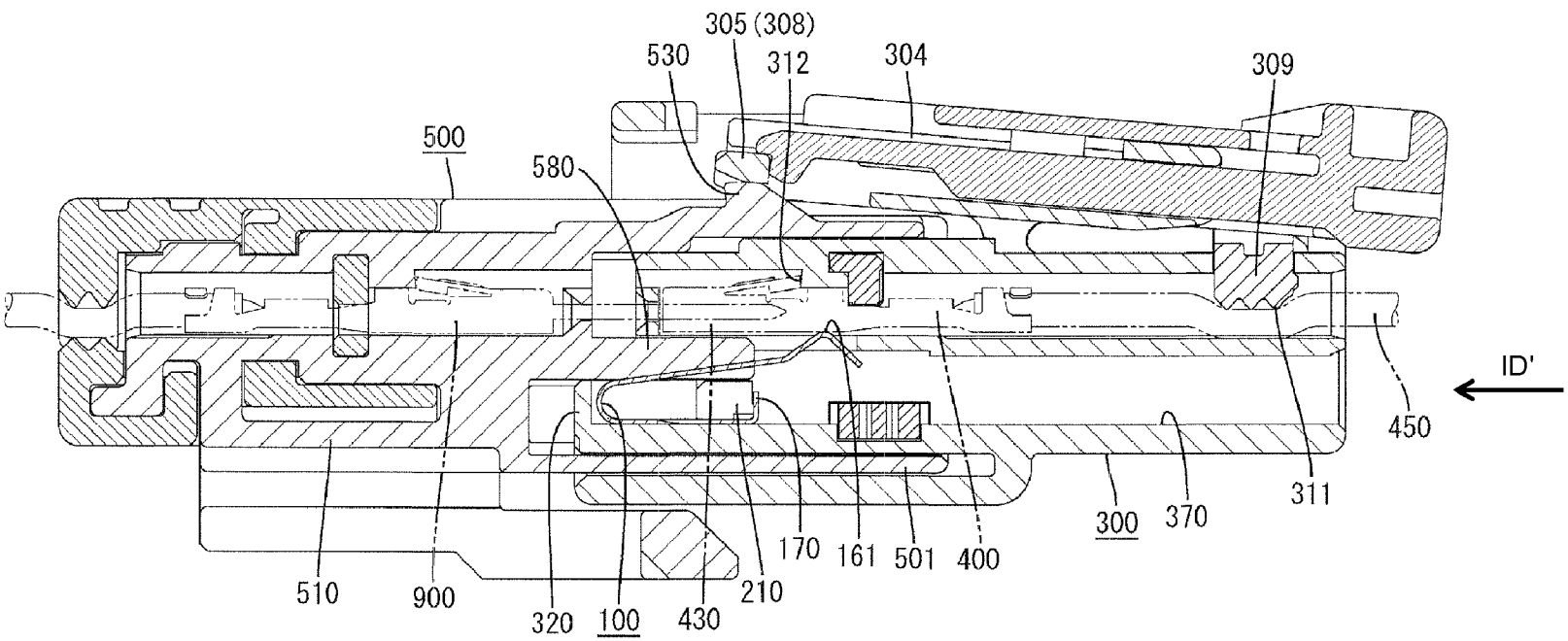
FIG. 8 is a side view in section showing an intermediate state of a connecting operation of the connectors.
Figure 9:
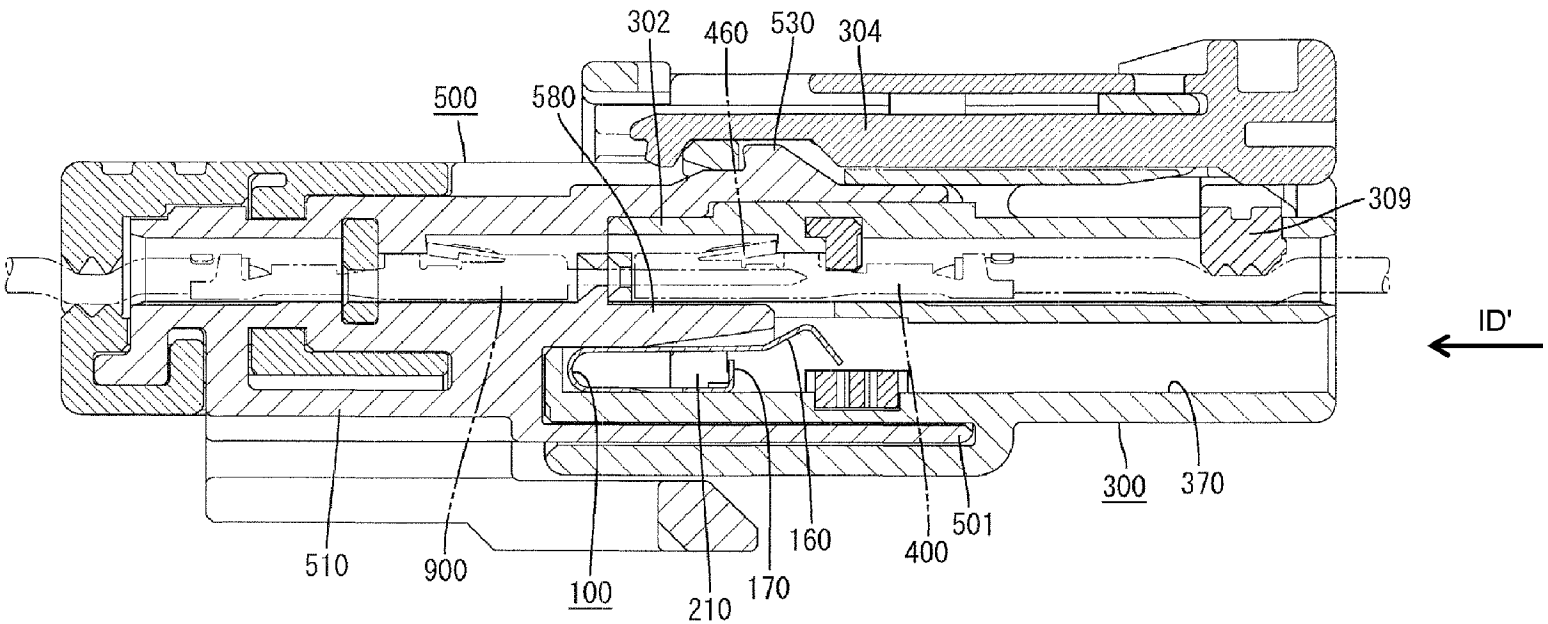
FIG. 9 is a side view in section showing a state after the connectors are connected.

The housing 50 is made e.g. of a synthetic resin and is connectable with and separable from a mating female housing 30 as shown in FIG. 1. As shown in FIG. 6, the housing 50 is long and narrow in forward and backward directions FBD (connecting and separating directions CSD) and includes a block-shaped terminal accommodating portion 51 and a substantially tubular receptacle 52 projecting forward from the periphery of the front end of the terminal accommodating portion 51. The outer peripheral edges of the lower halves of the terminal accommodating portion 51 and the receptacle 52 have substantially arcuate shapes (see FIG. 3).

The upper wall of the receptacle 52 has a substantially flat outer surface that extends along the forward and backward directions FBD and a lock 53 projects from this surface. A resiliently deformable lock arm 31 is formed in the mating female housing 30 and is engageable with the lock 53 to lock the two housings 10, 30 in their connected state. A connection detector 33 is arranged in the mating female housing 30 and can slide in forward and backward directions FBD on the upper surface of the lock arm 31 only when the two housings 10, 30 are connected properly, and hence can detect whether the two housings 10, 30 are connected properly.

Three cavities 54 are formed substantially side by side in a row in the housing 50, and the terminal fittings 40 are insertable into the cavities 54 from behind. A stepped terminal receiving portion 55 is formed in an inner wall of each cavity 54 for receiving the metal lock 46 and for preventing the terminal fitting 40 from coming out of the cavity 54. Thus, the terminal main portion 43 and the wire connection barrel 42 are accommodated in the cavity 54 and the tab 41 projects into the receptacle 52. An end of the wire 45 extends in forward and backward directions FBD in the cavity 54 and the remainder of the wire 45 is drawn to the outside through the rear end opening of the cavity 54.

A retainer mount hole 56 is formed in one outer side surface of the terminal accommodating portion 51 and communicates with the respective cavities 54. The retainer 80 has a retainer main body 81 that is insertable into this retainer mount hole 56 in an insertion direction that is substantially normal to the forward and backward directions FBD. The retainer 80 is movable between a partial locking position and a full locking position. The terminal fittings 40 can be inserted into and withdrawn from the cavities 54 when the retainer is at the partial locking position. However, the retainer 80 at the full locking position engages the properly inserted terminal fittings 40 and retains the properly inserted terminal fittings 40 in the cavities 54. A wire pressing portion 82 is connected movably with the retainer 80 via a hinge 83. Sawtooth-shaped projections 84 on the wire pressing portion 82 press against and bite into the insulation coatings of the wires 45 when the retainer 80 reaches the full locking position to prevent loose movements of the wires 45 in the cavities 54.

A shorting terminal accommodating chamber 57 is formed in the outer side surface of the terminal accommodating portion 51 where the retainer mount hole 56 is formed. More specifically, the shorting terminal accommodating chamber 57 is adjacent to and below a pair of adjacent cavities 54 and a front upper part of the shorting terminal accommodating chamber 57 communicates with the two cavities 54. The front surface of the shorting terminal accommodating chamber 57 opens in the front surface of the terminal accommodating portion 51, and the shorting terminal accommodating chamber 57 extends in forward and backward directions FBD substantially parallel with the two cavities 54.

An automatic machine inserts the shorting terminal 10 sideways and in a direction substantially normal to the connecting and separating directions CSD of the two housings 10, 30 through a lateral opening and into the shorting terminal accommodating chamber 57. The shorting terminal 10 has touching pieces 11. Leading ends of touching pieces 11 pass through the opening in the front surface of the terminal accommodating portion 54 and enter the receptacle 52 when the shorting terminal 10 is mounted. The closing plate 89 of the retainer 80 closes the lateral opening in the shorting terminal accommodating chamber 57 as the retainer 80 reaches the full locking position to protect the shorting terminal 10 (see FIG. 6).

Figure 3:
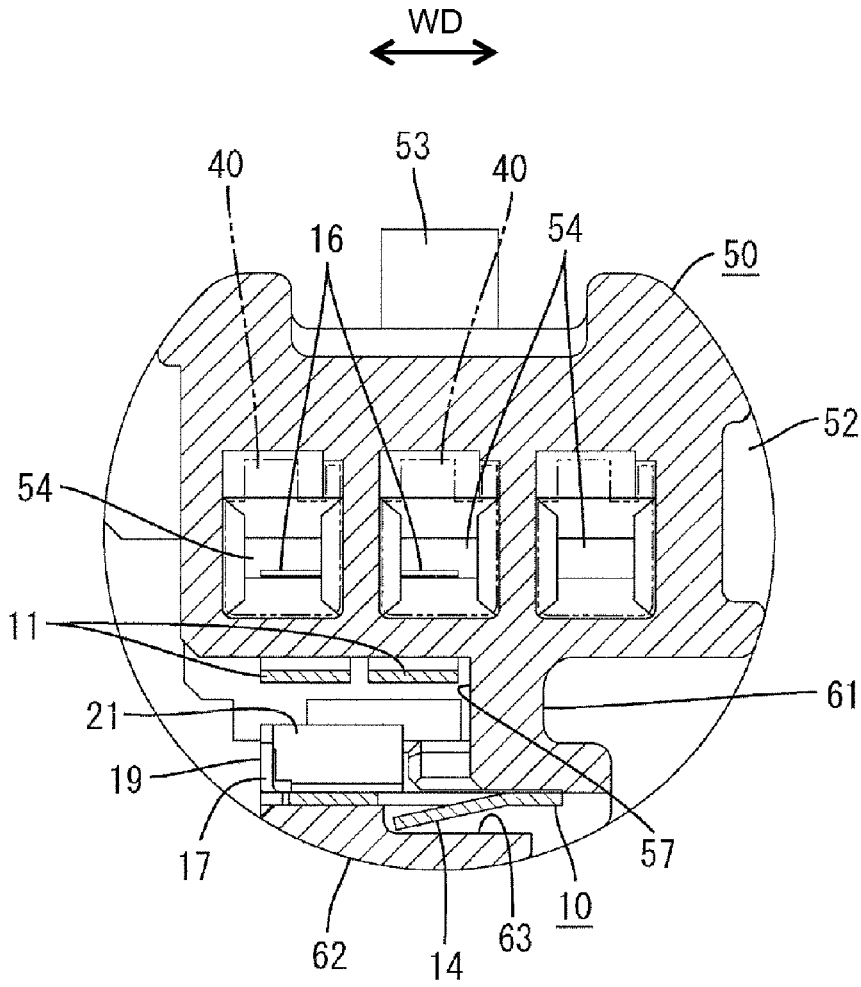
FIG. 3 is a vertical section of the connector.

The retainer mount hole 56 is arranged behind and slightly above the shorting terminal accommodating chamber 57. A retainer fitting recess 58 is formed in the rear end of the outer peripheral surface of the terminal accommodating portion 51. An outer frame 85 of the retainer 80 is mounted in the retainer fitting recess 58. A rear partition wall 59 is defined in the shorting terminal accommodating chamber 57 between the retainer mount hole 56 and the retainer fitting recess 58. The shorting terminal accommodating chamber 57 also has a side partition wall 61 and a bottom wall 62, as shown in FIG. 3. The side partition wall 61 hangs down at a position slightly displaced from the widthwise center of the terminal accommodating portion 51 towards a side opposite to the lateral opening. A locking groove 63 is formed in the bottom surface of the shorting terminal accommodating chamber 57 and extends in the width direction WD to the side opposite to the lateral opening below and across the side partition wall 61. A locking groove 64 is formed in the bottom surface of the shorting terminal accommodating chamber 57 and extends in the width direction WD along a boundary to the receptacle 52.

A bottom wall 66 of the receptacle 52 has a part thicker than the bottom wall 62 of the terminal accommodating portion 51 so that the height of the upper surface of the bottom wall 66 of the receptacle 52 is higher than the bottom surface of the shorting terminal accommodating chamber 57 in this part. An escaping recess 67 is formed in the inner upper surface of the bottom wall 66 of the receptacle 52 for receiving the leading ends of the touching pieces 11 upon the action of the shorting terminal 10. The bottom surface of the escaping recess 67 is set substantially at the same height as the bottom surface of the shorting terminal accommodating chamber 57.

Figure 4:
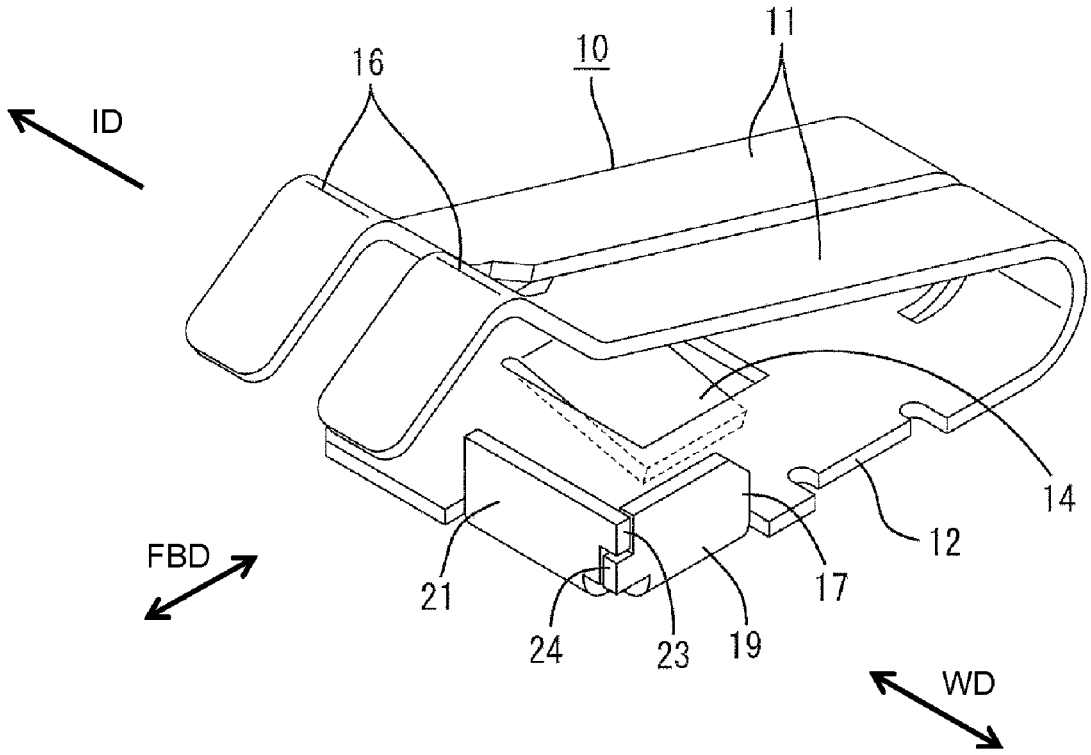
FIG. 4 is a perspective view of a shorting terminal.
Figure 5:
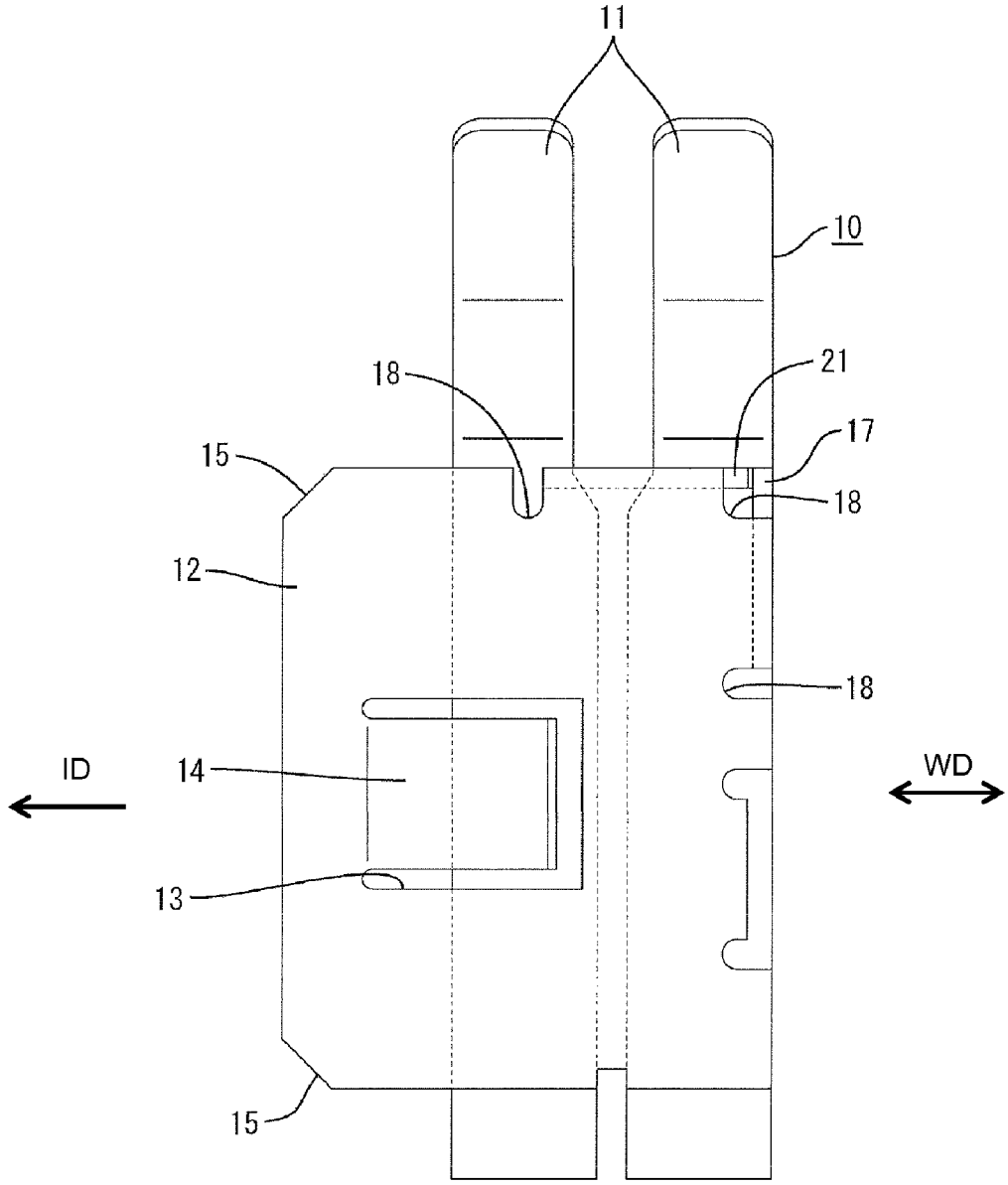
FIG. 5 is a bottom view of the shorting terminal.

The shorting terminal 10 is formed of an electrically conductive metal plate material and includes a plate-shaped shorting terminal main body 12 to be arranged substantially horizontally along the bottom surface of the shorting terminal accommodating chamber 57. Two touching pieces 11 project from the rear ends of the shorting terminal main body 12, as shown in FIGS. 4 and 5. A substantially U-shaped slit 13 is formed in the shorting terminal main body 12, and a resiliently deformable locking piece 14 is formed by bending a plate defined by the slit 13. More specifically, the locking piece 14 is aligned oblique to an inserting direction ID and extends into the shorting terminal accommodating chamber 57. Thus, the locking piece 14 slides in contact with the back surface of the locking groove 63 in the process of mounting the shorting terminal 10, and is fit into the locking groove 63 as the shorting terminal 10 is mounted properly. Bevels 15 are formed at opposite corners of the front end of the shorting terminal main body 12 with respect to the inserting direction ID. The bevels 15 guide the shorting terminal 10 into the shorting terminal accommodating chamber 57.

The two touching pieces 11 are preferably in an eccentric manner towards the rear end in the inserting direction ID into the shorting terminal accommodating chamber 57, and are brought resiliently into contact with the respective terminal fittings 40 accommodated in the middle and left cavities 54 in FIG. 3. More specifically, the touching pieces 11 are cantilevers joined to the rear end of the shorting terminal main body 12, but are folded to extend forward. Additionally, the touching pieces 11 are resiliently displaceable up and down towards and away from the portion of the shorting terminal main body 12 to be arranged along the bottom surface of the shorting terminal accommodating chamber 57. Pointed or mountain-shaped touching portions 16 are bent near the leading ends of the touching pieces 11. The leading ends of the two touching pieces 11 project into the receptacle 52, and the touching portions 16 can resiliently contact the lower surfaces of the tabs 41 of the corresponding terminal fittings 40. At least one of the two touching pieces 11 is resiliently deformed down in a disengaging direction by at least one disengaging portion 38 formed in the mating female housing 30 as the two housings 10, 30 are connected, thereby separating the touching portions 16 from the tabs 41.

A contact piece 17 extends from the rear end of the shorting terminal main body 12 with respect to the inserting direction ID into the shorting terminal accommodating chamber 57 and can be pushed in by a jig or the like into the shorting terminal accommodating chamber 57. The contact piece 17 is formed by cutting slits 18 in the metal plate and then bending the plate piece between the slits 18 up at a substantially right angle. The contact piece 17 partly overlaps the right touching piece 11 in the width direction WD in FIG. 5, and is in the resilient deformation range of the touching piece 11. The plate surface of the contact piece 17 extends in substantially forward and backward directions FBD. The length of the contact piece 17 in forward and backward directions FBD is less than about half, more preferably slightly less than about ⅓ of the entire length of the shorting terminal main body 12. A pushable surface 19 faces out on the contact piece 17 and is aligned substantially normal to the inserting direction ID into the shorting terminal accommodating chamber 57. The pushable surface 19 can be pressed by a jig.

A support 21 is formed by cutting slits 18 into the metal plate and then bending the area between the slits 18 into an alignment substantially normal to both the shorting terminal main body 12 and the contact piece 17. The support 21 is in contact with a surface the contact piece 17 opposite the pushable surface 19. The plate surfaces of the support 21 extend substantially along the width direction WD and along the inserting direction ID into the shorting terminal accommodating chamber 57. The length of the support 21 in the width direction WD is about ½ of the width of the shorting terminal main body 12 and is longer than the length of the contact piece 17 in forward and backward directions FBD. The support 21 is arranged to at least partly overlap both touching pieces 11 in the width direction and is within the resilient deformation ranges of the both touching pieces 11.

The support 21 and the contact piece 17 are engaged by interlocking projections and recesses on the lateral edges facing each other, and the plate surfaces thereof cross at substantially right angles to define an L-shape in plan view. More specifically, a projection 23 on the upper portion of one lateral edge of the support 21 and aligns with and fits in a cutout recess in the corresponding upper portion of one lateral edge of the contact piece 17. Similarly, a projection 24 on the lower portion of the lateral edge of the contact piece 17 aligns with and fits in a cutout recess in the corresponding lower portion of the lateral edge of the support 21. The support 21 and the contact piece 17 stand up by substantially the same projecting distance so that the upper ends thereof substantially are horizontal.

Next, functions of this embodiment are described. At first, an operation of accommodating the shorting terminal 10 and the terminal fittings 40 into the connector housing 50 is described. In the following description, the shorting terminal 10 preferably is at least partly accommodated first, but the terminal fittings 40 may be conversely accommodated first.

The connector housing 50 and the shorting terminal 10 are set in the automatic machine and the machine then pushes the shorting terminal 10 into the shorting terminal accommodating chamber 57 of the housing 50 along the inserting direction ID. More particularly, the jig of the automatic machine pushes the pushable surface 19 of the contact piece 17 to displace the shorting terminal 10 substantially straight in the width direction WD and parallel to the plate surfaces of the supporting piece 21. A pushing force is given to the contact piece 17 in the push-in direction. However, this pushing force also is distributed to the support 21 supporting the contact piece 17 at the side opposite to the pushable surface 19, and therefore is not concentrated only on the contact piece 17.

The pushing operation is stopped automatically when the shorting terminal 10 is pushed by a specified stroke by the automatic machine. If the shorting terminal 10 reaches a substantially proper mount position in this way, the locking piece 14 engages the back surface of the locking groove 63 to retain the shorting terminal 10. Further, the locking piece 14 engages the side surface of the locking groove 63 and the front end of the shorting terminal main body 12 is fit closely into the mount guiding groove 64 to prevent shaking movements of the shorting terminal 10 in width direction WD. In this state, both touching pieces 11 cross the interior of the shorting terminal accommodating chamber 57 obliquely forward and the touching portions 16 are located at height corresponding to the front positions of the two cavities 54.

Both touching pieces 11 are pressed down towards the shorting terminal main body 12 in the process pushing the shorting terminal 10 into the shorting terminal accommodating chamber 57 to avoid interference with the opening edge of the lateral opening of the shorting terminal accommodating chamber 57. An attempt could be made to press the touching pieces 11 down excessively. However, the lower surfaces of the touching pieces 11 contact at least one of the contact piece 17 and the support 21 to limit the downward deflection of the touching pieces 11.

Subsequently, the retainer 80 is held at the partial locking position and the terminal fittings 40 connected with the ends of the wires 45 are inserted into the corresponding cavities 54 from behind. In the process of inserting the terminal fittings 40 into the left and middle cavities 54 in FIG. 3, portions of the tabs 41 that project into the receptacle 52 contact the touching portions 16 of the shorting terminal 10. As a result, the touching pieces 11 are pressed down and away from the terminal fittings 40. The terminal fittings 40 inserted into the cavities 54 are locked primarily by the metal locks 46 while being held resiliently in contact with the touching portions 16 at the base ends of the tabs 41. The retainer 80 then is moved to the full locking position so that the retainer main body 81 locks the terminal fittings 40 secondarily. In this state, the two terminal fittings 40 are shorted by the two touching pieces 11 of the shorting terminal 10 and there is no potential difference between the two terminal fittings 40.

The disengaging portion 38 of the mating female housing 30 press the touching pieces 11 down and away from the terminal fittings 40 when the two housings 10, 30 are connected properly to separate the touching portions 16 from the tabs 41 of the terminal fittings 40 to cancel the shorted state of the two terminal fittings 40.

As described above, the shorting terminal 10 has a support 21 that contacts the contact piece 17 from the side opposite to the inserting direction ID of the shorting terminal 10 into the shorting terminal accommodating chamber 57. Thus, the support 21 supports the contact piece 17 from the rear and the contact piece 17 will not incline and deform in the push-in direction ID when the jig is pressed against the contact piece 17. Accordingly, the specified pushing stroke by the automatic machine positions the shorting terminal 10 correctly at the proper position in the housing 50.

The contact piece 17 and the support 21 are arranged to contact the touching pieces 11 before the touching pieces 11 deform excessively. Thus, excessive deformations of the touching pieces 11 are prevented and satisfactory resilient forces are ensured for the touching pieces 11 even if the shorting terminal 10 is used repeatedly.

The plate surfaces of the contact piece 17 and the support 21 are aligned at substantially right angles to each other and the crossing ends are interlocked by the engagement of the recesses and projections. Thus, a supporting force by the support 21 is increased and deformation of the contact piece 17 by the jig is prevented more reliably. With the above construction, it becomes possible to operate the jig on the support 21 in a direction normal to the push-in direction against the contact piece 17 and to use the support 21 as the contact piece 17 and the contact piece 17 as the support 21. In other words, the shorting terminal 10 can be used in a case where the mounting direction extends from the opening end of the receptacle toward the back end thereof.

A second embodiment of the invention is described with reference to FIGS. 7 to 14. The connector of the second embodiment, has a shorting terminal 100 accommodated in a female housing 300 and a disengaging portion 580 is formed in a mating male housing 500.

The housing 300 is made e.g. of a synthetic resin and includes a housing main body 302 with cavities 301 for accommodating female terminal fittings 400 and a fitting tube 303 surrounds the housing main body 302. A mating receptacle 501 is fittable between the housing main body 302 and the fitting tube 303 from the front and along connecting and separating directions CSD. A mount space for a connection detector 330 penetrates the housing 300 in forward and backward directions FBD between the upper surface of the housing main body 302 and the lower surface of the fitting tube 303. A lock arm 304 is formed on the upper surface of the housing main body 302, and the connection detector 330 is mounted to be connectable with the lock arm 304. The connection detector 330 is movable between a standby position and a detecting position with respect to the lock arm 304. Normally, the connection detector 330 is engaged with a restriction 304 on the lock arm 304 that keeps the connection detector 330 at the standby position and prevents movement of the connection detector 330 to the detecting position. However, the connection detector 330 is disengaged from the restriction 305 only when the two housings 300, 500 are connected properly and hence is permitted to move to the detecting position. Accordingly, a connected state of the two housings 300, 500 can be detected or verified depending on whether the movement of the connection detector 330 is possible.

Figure 11:
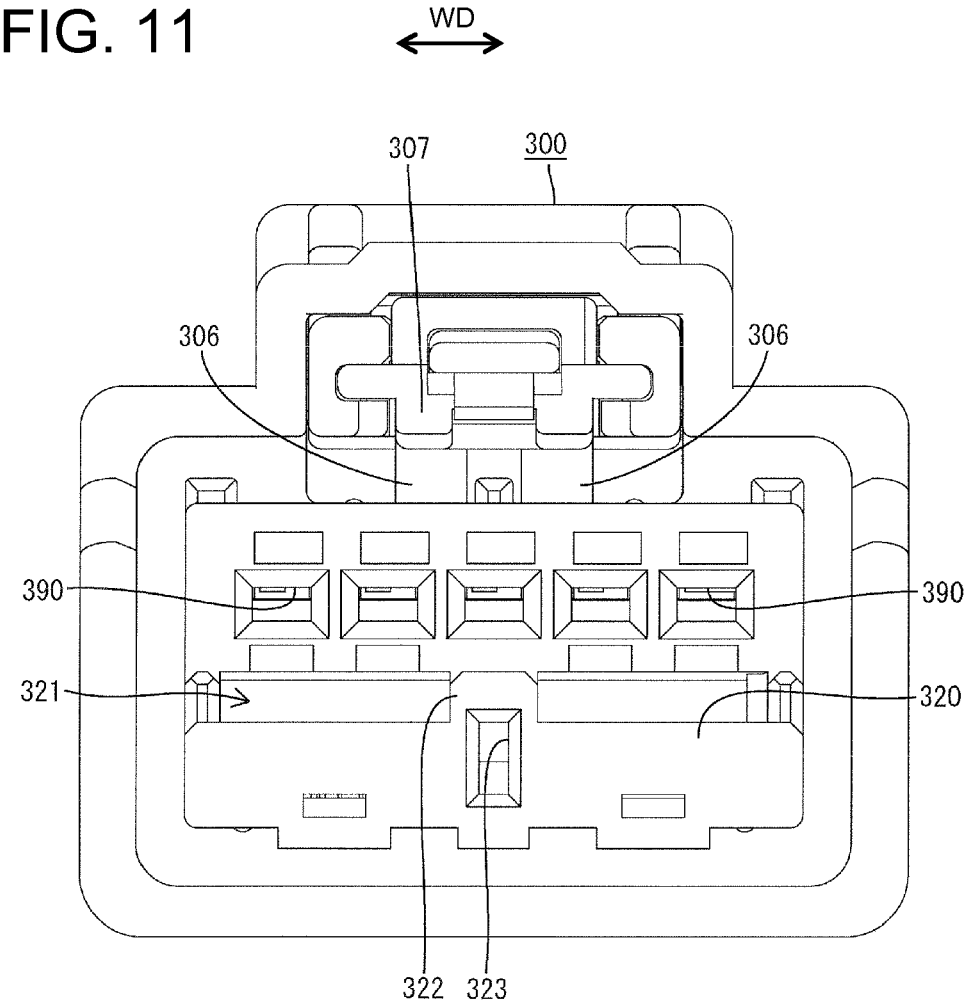
FIG. 11 is a front view of a female connector housing.
Figure 12:
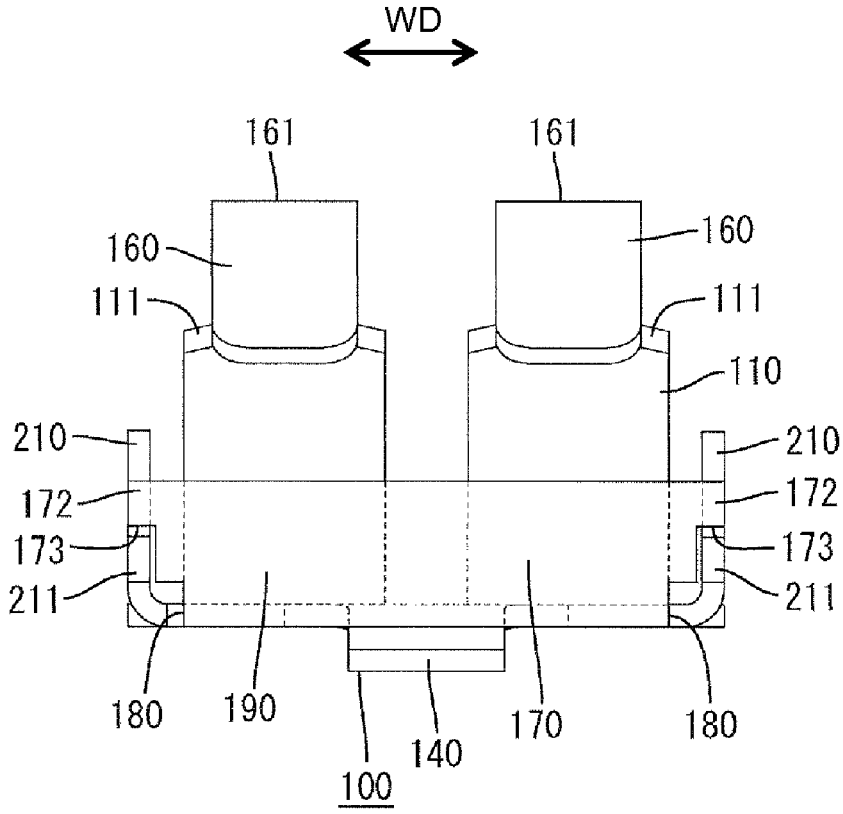
FIG. 12 is a rear view of a shorting terminal.
Figure 13:
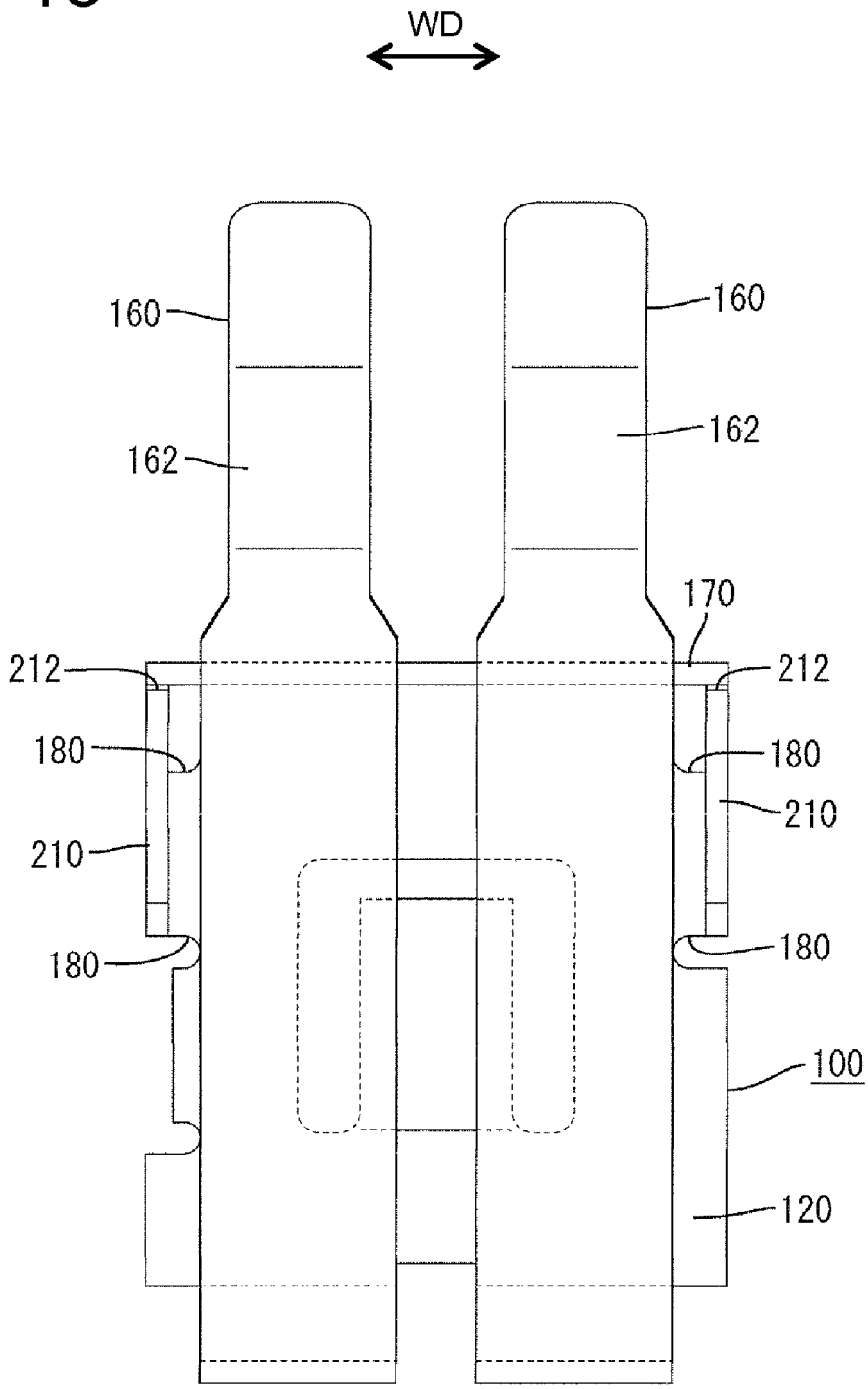
FIG. 13 is a plan view of the shorting terminal.
Figure 14:
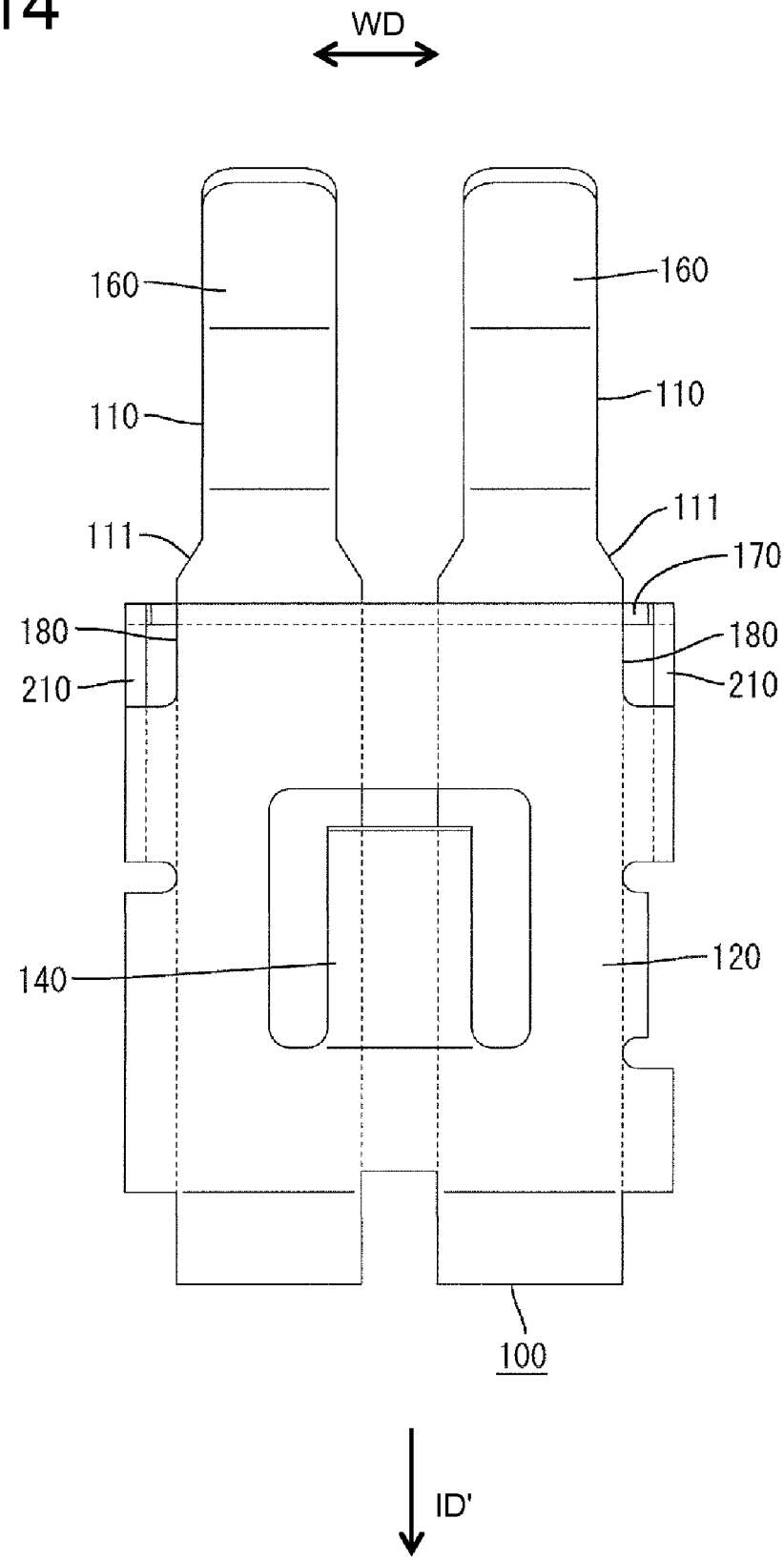
FIG. 14 is a bottom view of the shorting terminal.

As shown in FIG. 11, legs 306 stand up from an intermediate part of the upper surface of the housing main body 302 in forward and backward directions FBD and an arm portion 307 extends in forward and backward directions FBD from the upper ends of the legs 306. The arm portion 307 is pivotally displaceable like a seesaw with the legs 306 as supports. An interlocking portion 308 is formed at the leading end of the lock arm 304 and is engageable with a mating lock 530. The interlocking portion 308 doubles as the restriction 305.

An accommodating chamber 310 for a wire pressing member 309 is formed in the rear end of the upper surface of the housing main body 302 and communicates with the cavities 301. The wire pressing member 309 has sawtooth-shaped projections 311 that bite into the insulation coatings of the wires 450 to prevent loose movements of wires 450 in the cavities 301. The wire pressing member 309 inserted into the accommodating chamber 310 is covered by the connection detector 330 from above so that the wire pressing member 309 is prevented from accidentally coming out of the accommodating chamber 310.

Cavities 301 are formed substantially side by side in a row in the housing main body 302. A stepped terminal receiving portion 312 is formed at an inner wall of each cavity 301, and a metal lock 460 of the female terminal fitting 400 is engageable with the terminal receiving portion 312. Shorting terminal accommodating chambers 370 are formed adjacent to and below the cavities 301 in the housing main body 302.

The shorting terminal accommodating chambers 370 penetrate the housing main body 302 in forward and backward directions FBD substantially in parallel with the cavities 301. An insertion opening is defined in rear of each shorting terminal accommodating chamber 370 and is configured for receiving the shorting terminal 100. Front ends of the shorting terminal accommodating chambers 370 are located before the front surfaces of the cavities 301, and lower portions thereof are closed by a front wall 320 that stands up from the bottom front end of the housing main body 302. The front wall 320 extends substantially vertically and covers the shorting terminal accommodating chambers 370 over substantially the entire widths and functions to limit forward movements of the properly mounted shorting terminals 100 and to protect the shorting terminals 100. An insertion path 321 for the disengaging portion 580 is formed above the front wall 320. A projecting piece 322 is formed in the widthwise center of the upper edge of the vertical wall 320, and a window 323 penetrates the front wall 320 in forward and backward directions FBD inwardly of the projecting piece 322. A front part of each shorting terminal accommodating chamber 370 communicate with front parts of the two cavities 301 adjacent to each other at a corresponding widthwise side, and the shorting terminal 100 can contact the substantially box-shaped terminal main bodies 430 of the terminal fittings 400 through these communicating parts.

The shorting terminal 100 is formed of an electrically conductive metal plate material and includes a shorting terminal main body 120 arranged substantially horizontally along the bottom surface of the shorting terminal accommodating chamber 370 and two touching pieces 110 projecting from the front ends of the shorting terminal main body 120. The shorting terminal main body 120 preferably is a substantially rectangular plate, and a locking piece 140 is cut at a middle part of the shorting terminal main body 120 and bent to extend obliquely down towards the back. The locking piece 140 of the properly inserted shorting terminal 100 engages the bottom surface of the shorting terminal accommodating chamber 370 to retain the shorting terminal 100.

The touching pieces 110 are folded back from the front end of the shorting terminal main body 120 to cantilever backward, and are resiliently displaceable up and down with the leading end of the shorting terminal main body 120 as a base end. Tapers 111 are formed at intermediate positions of the touching pieces 110 in their extending direction and narrow touching portions 160 extend rearward from the tapers 111 to the leading ends of the touching pieces 110.

Each touching portion 160 is bent into a pointed or mountain-shape in side view and includes a contact 161 at its apex for contacting the terminal fitting 400. A slanted surface 162 slopes down and towards the front from the contact 161. The slanted surfaces 162 of the touching portions 160 are located above the upper end of the front wall 320 and in the insertion path 321 for the disengaging portion 580 in a mounted state of the shorting terminal 100. The leading end of the disengaging portion 580 contacts the slanted surface 162 to deform the resilient touching portions 160 away from the terminal fittings 400.

The shorting terminal 100 is formed with a contact piece 170 and a support 210. The contact piece 170 is bent up at a substantially right angle at the rear end edge of the shorting terminal main body 120, and the opposite plate surfaces of the contact piece 170 are oriented in substantially forward and backward directions FBD. More specifically, the contact piece 170 is in the form of a rectangular plate that is long and narrow in the width direction WD and extends over substantially the entire width of the rear end edge of the shorting terminal main body 120. A pushable surface 190 faces rearwardly on the contact piece 170. Wider areas of the both touching pieces 110 are arranged above the contact piece 170, so that both touching pieces 110 contact the upper end edge of the contact piece 170 to prevent excessive downward deformations of touching pieces 110. Slits 180 are formed in the rear edge of the shorting terminal main body 120 at the opposite left and right sides of the contact piece 170. The slits 180 enable the contact piece 170 to be bent smoothly bent and are at an inner side of the shorting terminal main body 120. Two projections 172 project substantially in the width direction WD at the upper ends of the opposite lateral edges of the contact piece 170, and recesses 173 are formed below the projections 172.

On the other hand, supports 210 are bent up at substantially at right angles at the opposite lateral edges of the shorting terminal main body 120, and the opposite plate surfaces of the supports 210 are oriented inwardly in left and right directions. More specifically, the supports 210 are substantially in the form of rectangular plates located at the rear ends of the opposite lateral edges of the shorting terminal main body 120 and are taller than the contact piece 170. The supports 210 are located more outward in the width direction than the touching pieces 110 and do not interfere with the touching pieces 110 even if the touching pieces 110 were deformed excessively. Slits 180 are formed in each of the opposite lateral edges of the shorting terminal main body 120 at the front and rear ends of the support 210. The slits 180 enable each support 210 to be bent smoothly and can be arranged at an inner side of the shorting terminal main body 120. The rear slits 180 communicate with the slits 180 at the opposite sides of the contact piece 170 and are formed by cutting the two corners of the rear end edges of the shorting terminal main body 120. Two projections 211 project back at the bottom of the rear end of the supports 210, and recesses 212 are formed above the projections 211. The projections 211 of the supports 210 align with and fit into the recesses 173 of the contact piece 170 and the projections 172 of the contact piece 170 align with and fit into the recesses 212 of the supports 210. Thus, the supports 210 and the contact piece 170 are interlocked with each other by the engagement of the projections 172, 211 and the recesses 173, 212 crossing substantially at right angles. It should be noted that the bottom edges of the projections 211 of the supporting pieces 210 are continuous with the upper edges of the rear slits 180.

The mating male housing 500 is made e.g. of a synthetic resin material and includes a terminal accommodating portion 510 and a tubular receptacle 501 projects at the front end of the terminal accommodating portion 510 similar to the first embodiment. A lock 530 projects from the upper surface of the upper wall of the receptacle 501. Cavities 502 are arranged substantially side by side in a row in the terminal accommodating portion 510 and are at positions corresponding to the cavities 301. Male terminal fittings 900 are insertable into the respective cavities 502 from behind so that tabs 902 of the terminal fittings 900 project into the receptacle 501.

Disengaging portions 580 are cantilevered forward from the back wall of the receptacle 501 and are substantially parallel with the tabs 902 at positions below and adjacent to the tabs 902. The front ends of the disengaging portions 580 are slightly behind the front ends of the tabs 902. An accommodating recess 505 having a bottom surface behind the front surfaces of the cavities 502 is provided right below the disengaging portions 580, and the front wall 320 can fit into the accommodating recess 505.

Figure 10:
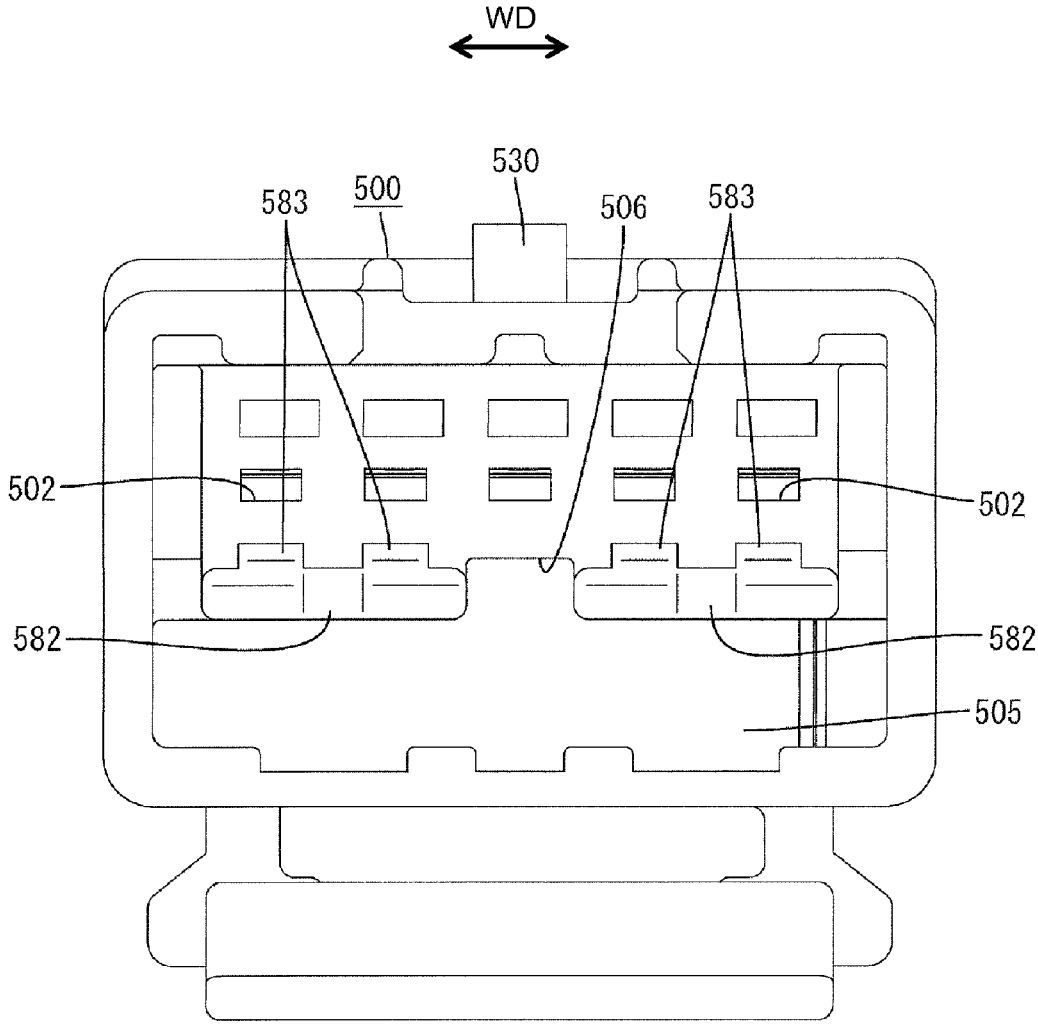
FIG. 10 is a front view of a male connector housing.

As shown in FIG. 10, two disengaging portions 580 are arranged substantially side by side in the width direction WD in correspondence with the shorting terminals 100 and a fitting groove 506 communicates with the accommodating chamber 505 between the two disengaging portions 580. The projecting piece 322 of the front wall 320 is insertable into the fitting groove 506. Disengagement guiding surfaces 581 are provided at the opposite widthwise sides of the lower surfaces of the respective disengaging portions 580 for contacting the contact portions 161 of the shorting terminals 100 to deform the touching pieces 110. The disengagement guiding surfaces 581 are sloped down towards the back, and can slide in contact with the slanted surfaces 162 of the contact portions 161 in the disengaging direction of the shorting terminals 100.

Each disengaging portion 580 includes a first rib 582 between the two disengagement guiding surfaces 581 two second ribs 583 paired in the width direction WD at positions vertically overlapping with the two disengagement guiding surfaces 581 in the height direction. The first rib 582 extends over the formation range of the two disengagement guiding surfaces 581 in forward and backward directions FBD, and the second ribs 583 extend over substantially their entire lengths along the upper surface of a main part of the disengaging portion 580 in forward and backward directions FBD. The second ribs 583 have substantially the same thickness as the main part of the disengaging portion 580, and the first rib 582 has a thickness to compensate for the main part of the disengaging portion 580 thinned by forming the disengagement guiding surfaces 581.

The housing 300 and the shorting terminals 100 can be positioned with respect to each other in an unillustrated automatic machine. The machine then inserts the shorting terminals 100 from behind through the insertion openings and into the respective shorting terminal accommodating chambers 370 along an inserting direction ID' that extends parallel to the forward and backward directions FBD. Jigs of the automatic machine are pressed against the pushable surfaces 190 of the contact pieces 170 to slide the shorting terminals 100 forward in the inserting direction ID'. Thus, a pushing force acts on the contact pieces 170 in their push-in direction ID'. However, the supports 210 support the opposite widthwise ends of the surfaces of the contact pieces 170 opposite to the pushable surfaces 190, and as a result, the contact pieces 170 are not inclined in the push-in direction of the jigs. Further, in the moving process, the two touching pieces 110 are pressed from above to be resiliently deformed, but the upper edge of the contact piece 170 contacts the touching pieces 110 to prevent excessive deformations of the touching pieces 110.

The shorting terminals 100 reach proper mount positions near the rear surface of the front wall 320 and are prevented from coming out of the shorting terminal accommodating chambers 370 by the locking pieces 140. In this state, both touching pieces 110 extend obliquely back into the corresponding shorting terminal accommodating chamber 370, and the contacts 161 of the touching portions 160 are in the front parts of the two cavities 301. Thereafter, the terminal fittings 400 are inserted into the cavities 301 and engage the contacts 161 of the shorting terminals 100 and resiliently deform the touching pieces 110 down towards the shorting terminal main body 120 in the inserting process. The terminal fittings 400 in the accommodating chambers 370 engage the contacts 161 of the touching portions 160 and the adjacent terminal fittings 400 are shorted with each other via the contacts 161.

The two housings 300, 500 are connected after all of the terminal fittings 400 are inserted. The disengagement guiding surfaces 581 of the disengaging portions 580 slide in surface contact with the slanted surfaces 162 of the touching portions 160 in the connecting process to guide smooth resilient deformations of the touching pieces 110. Further, the first ribs 582 prevent lateral shaking of the touching pieces 110. The touching pieces 110 are separated from the disengagement guiding surfaces 581 and contact the lower horizontal surfaces of the base ends of the disengaging portions 580 when the two housings 300, 500 are connected properly. As a result, the touching pieces 110 are bent horizontally and kept in their horizontal postures. The shorted state of the terminal fittings 400 is canceled when the touching pieces 110 are pushed down to separate the contacts 161 of the touching portions 160 from the terminal fittings 400.

As described above, effects similar to those of the first embodiment can be obtained also in the second embodiment in which the shorting terminals 100 are accommodated in the female connector housing 300.

Since each disengaging portion 580 is formed with the first rib 582 and the second ribs 583 extending substantially in forward and backward directions FBD, the disengaging portions 580 are reinforced so that the breakage or the like of the disengaging portions 580 resulting from insufficient strength can be avoided even if the disengaging portions 580 become relatively narrower as the connector is miniaturized.

The invention is not limited to the above described and illustrated embodiments. For example, the following embodiments are also embraced by the technical scope of the present invention as defined by the claims.

The contact piece and the supporting piece may be engaged such that the plate surfaces thereof cross at an angle different from 0° or 180°, preferably substantially at right angles to be substantially T-shaped in plan view.

The contact piece and the supporting piece may be engaged such that the plate surfaces thereof cross at acute angles or obtuse angles.

The plate surfaces of at least either the contact piece or the supporting piece may be slightly inclined with respect to a vertical plane.

At least the contact piece or the supporting piece may not be arranged to overlap with the touching piece in width direction.

The invention is also applicable in the case where the shorting terminal is inserted into the shorting terminal accommodating chamber from front of the housing or in any other direction. In this case, as described in the first embodiment, the jig of the automatic machine may be pressed against the front surface of the supporting piece.

The invention is also applicable if the shorting terminal is fit manually into the shorting terminal accommodating chamber of the housing.

The first embodiment is also applicable in the case where the shorting terminal shorts the mating female terminal fittings. Generally, the shorting terminal may according to the present invention short the terminal fitting and/or the mating terminal fitting.

In the second embodiment, either the first ribs or the second ribs may be omitted. Further, only one second rib may be provided substantially in the widthwise center of each disengaging portion.

It should be understood that the supporting piece may be formed by bending a portion of the contact piece itself and may be engaged an edge of the shorting terminal main body particularly by means of recesses and projections provided on either one so as to be interlockable. Accordingly, the supporting piece supports the integrally or unitarily formed contact piece by engaging or being on the portion of the shorting terminal main body.

It should be understood that the shorting terminal may have an appropriate number of resiliently deformable touching pieces, i.e. the shorting terminal may be formed with two, three or more resiliently deformable touching pieces which can touch or contact a corresponding number of terminal fittings so as to be able to short the terminal fittings.

What is claimed is:

1. A shorting terminal to be accommodated in a housing to short terminal fittings in the housing, comprising:

a substantially plate-shaped main body having opposite front and rear edges spaced apart along a push-in direction into the housing and opposite first and second sides extending between the front and rear edges;

at least one contact piece bent up from the rear edge of the main body at a position adjacent the first side, the contact piece being pushed at the time of insertion into the housing;

at least one support bent up from the first side of the main body and supporting the contact piece from a side opposite to the push-in direction into the housing; and at least two resiliently deformable touching pieces bent up from the second side of the main body and extending beyond the support at the first side of the main body for touching and shorting the terminal fittings in the housing, at least one of the contact piece and the support being between the resiliently deformable touching pieces and the main body for preventing excessive deformation of the touching pieces.

2. The shorting terminal of claim 1, wherein plate surfaces of the contact piece and the support cross at an angle to each other, and crossing end portions of the contact piece and the support are interlocked by engagement of projections and recesses.

3. The shorting terminal of claim 1, further comprising at least one locking piece to lock the terminal fitting into the housing, the locking piece extending oblique to an inserting direction of the terminal fitting into a shorting terminal accommodating chamber of the housing.

4. The shorting terminal of claim 1, the main body is formed with bevels by having corners of the front end with respect to the inserting direction obliquely cut, so that insertion of the shorting terminal is guided by the bevels.

5. The shorting terminal of claim 3, wherein the locking piece is joined to the main body along a connection line extending parallel to the front and rear edges of the main body and substantially orthogonal to the first and second sides of the main body.

6. The shorting terminal of claim 1, wherein the contact piece is disposed for contacting at least one of the resiliently deformable touching pieces for preventing excessive resilient deformation of the touching piece.

7. The shorting terminal of claim 1, wherein the support is aligned with at least one of the resiliently deformable touching pieces for preventing excessive deformation of the touching piece.

* * * * *